US005204578A

United States Patent [19]

Dever et al.

[11] Patent Number: 5,204,578

[45] Date of Patent: Apr. 20, 1993

[54] HEAT SINK MEANS FOR METAL HALIDE LAMP

[75] Inventors: Timothy P. Dever, Fairview Park; Gary R. Allen, Chesterland; John M. Davenport, Lyndhurst; Gerald E. Duffy, Mentor, all of Ohio

[73] Assignee: General Electric Company, Schenectady, N.Y.

[21] Appl. No.: 884,606

[22] Filed: May 15, 1992

Related U.S. Application Data

[63] Continuation of Ser. No. 608,091, Nov. 1, 1990, abandoned.

[51] Int. Cl.[5] ..... H01J 61/52

[52] U.S. Cl. ..... 313/25; 313/44; 313/45; 313/46; 313/113; 313/39; 313/637; 313/641

[58] Field of Search ..... 313/25, 44, 45, 46, 313/113, 631, 632, 634, 623, 331, 332, 39, 637, 641

[56] References Cited

U.S. PATENT DOCUMENTS

| | | | |
|---|---|---|---|
| 2,103,227 | 12/1937 | Druyvesteyn | 313/44 |
| 2,177,704 | 10/1939 | Francis | 313/44 |
| 4,968,916 | 11/1990 | Davenport et al. | 313/631 |

*Primary Examiner*—Donald J. Yusko
*Assistant Examiner*—N. D. Patel
*Attorney, Agent, or Firm*—George E. Hawranko; Stanley C. Corwin

[57] ABSTRACT

Heat sink means are provided for a metal halide lamp to enable more light output during lamp start-up. A xenon-metal halide lamp employing the heat sink means is disclosed along an with automotive headlamp having this lamp for its light source.

18 Claims, 2 Drawing Sheets

Fig. 1
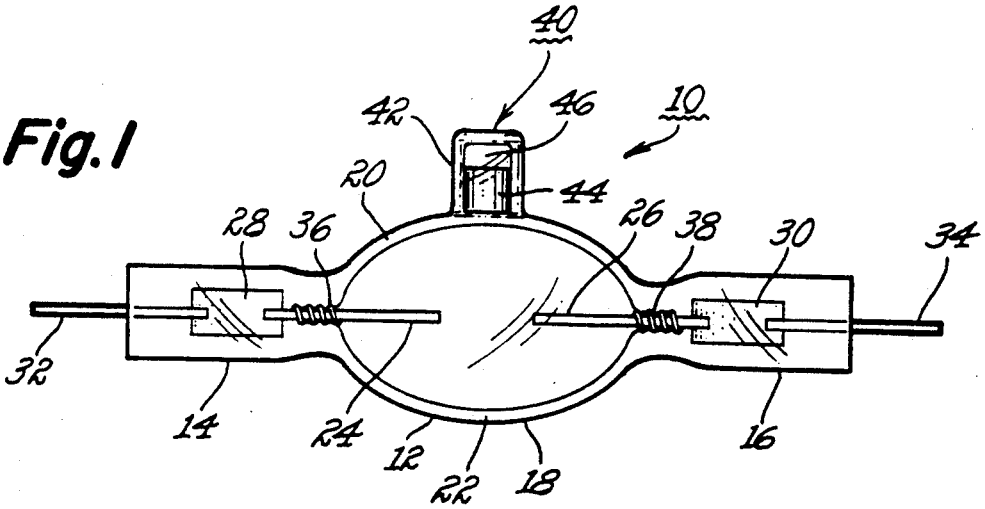
Fig. 3
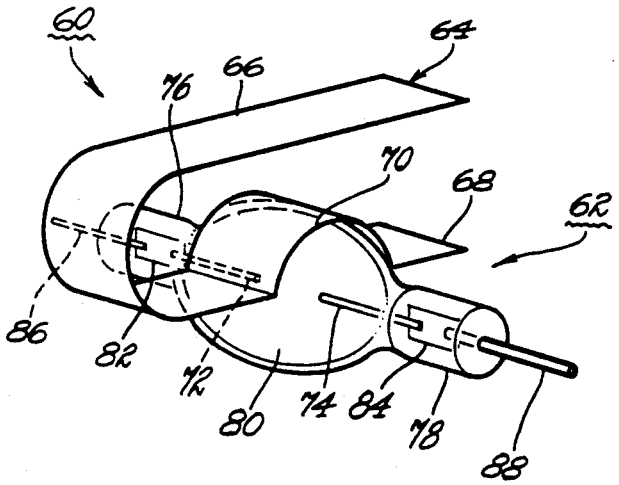
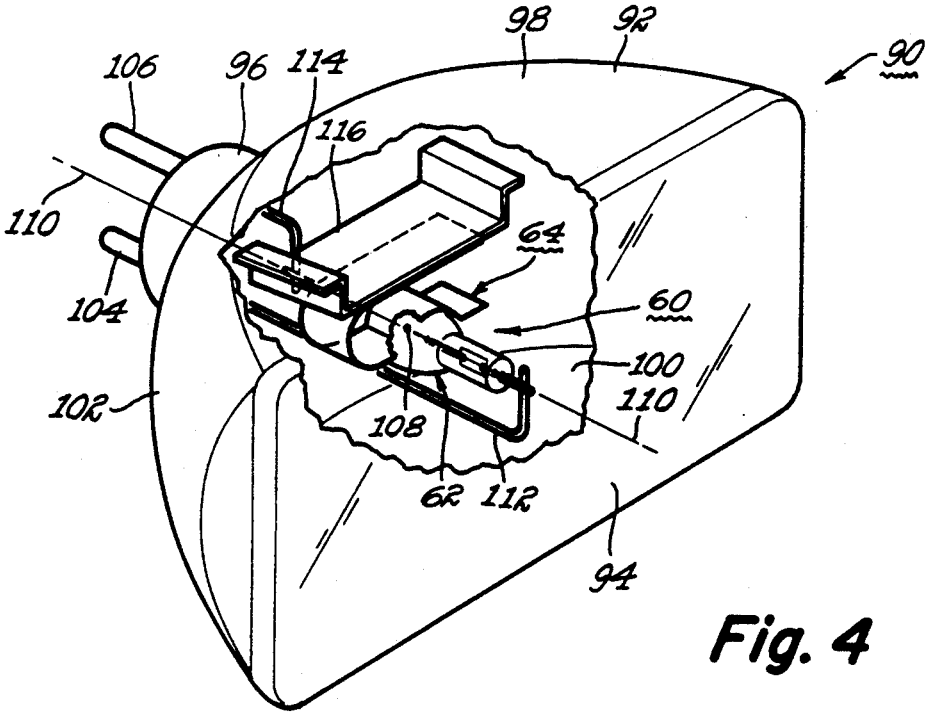
Fig. 4

HEAT SINK MEANS FOR METAL HALIDE LAMP

This application is a continuation of application Ser. No. 07/608,091, filed Nov. 1, 1990 and now abandoned.

RELATED PATENT APPLICATION

U.S. patent application Ser. No. 07/608,084, now U.S. Pat. No. 5,107,165 filed concurrently herewith for "Improving Initial Light Output for Metal Halide Lamp" in the names of the present inventors discloses a metal halide lamp employing discharge electrode means exercising more effective thermal management of mercury condensation within the lamp arc tube.

BACKGROUND OF THE INVENTION

This invention relates generally to means enabling improved light output from a metal halide discharge lamp and more particularly to achieving the improvement with heat sink means which regulate mercury condensation within the lamp arc tube in a distinctive manner.

Various metal halide discharge lamps commonly employ a fused quartz arc tube as the light source by reason of the refractory nature and optical transparency of this ceramic material. In such type lamps the arc tube generally comprises a sealed envelope formed with fused quartz tubing with discharge electrodes being hermetically sealed therein. A typical arc tube construction hermetically seals a pair of discharge electrodes at opposite ends of the sealed envelope although it is also known to have both electrodes being sealed at the same end of the arc tube. The sealed arc tube further contains a fill of various metal substances which become vaporized during the discharge operation. The fill includes mercury, sodium and metal halides along with one or more inert gases such as krypton, argon and xenon. Operation of such metal vapor discharge lamps can be carried out with various already known lamp ballast circuits employing either alternating current or direct current power sources.

For rapid sustained illumination with metal halide lamps, such as a xenon-metal halide lamp, a performance requirement now exists for at least fifty percent of the steady state light output to be reached within 0.75 seconds from the moment of lamp start-up. The prior art lamps experience significant light loss during start-up when the xenon discharge illumination is either absorbed or scattered by mercury which condenses upon the arc tube walls when first vaporized from the discharge electrodes. A "light hole" thereby results between the xenon illumination and less rapid illumination being produced by vaporization and ionization of the mercury and other metal ingredients further contained in the arc tube. By minimizing the light hole in these prior art lamps, a more sustained or continuous source of illumination is thereby provided.

Improved discharge electrode means are disclosed in the above referenced application to minimize occurrence of a light hole during lamp start and restart. A particular combination of anode and cathode means is therein disclosed significantly reducing the rate and maximum accumulation of mercury condensate on the arc tube walls during lamp start-up. Such improvement results from thermally managing mercury condensation during lamp cool-down so that condensation takes place adjacent the electrode means. More mercury is caused to condense at the anode end of the arc tube than condenses at the cathode end of the arc tube. Subsequent vaporization of condensed mercury from the anode means is also retarded during lamp restart. The cathode means have a dissimilar structural configuration relative to the anode means so as to exhibit a more rapid heating rate than the anode means during lamp start-up while further exhibiting a less rapid cooling rate than the anode means during lamp cool-down.

It is desired that further efficiency promoting means be provided to reduce light loss in a metal halide lamp. It is also desired to provide a metal halide lamp wherein condensed mercury is ionized without significant redeposition on the arc tube walls. In addition, it is desired to provide means enabling more rapid ionization of condensed mercury in a metal halide lamp.

Accordingly, it is an object of the present invention to provide means whereby metal halide lamps experience less light loss during start-up.

Another object of the present invention to provide an improved metal halide lamp employing a fused quartz arc tube as the light source which includes means for improved control of mercury condensation on the arc tube walls.

It is a still further object of the present invention to provide an improved automotive headlamp employing a metal halide lamp as the light source which experiences less light loss during start-up.

These and other objects of the present invention will become apparent upon considering the following more detailed description.

SUMMARY OF THE INVENTION

We have now found that heat sink means physically engaging the arc tube of a metal halide lamp in a particular manner reduces the above defined light hole problem. More particularly, the light hole is reduced according to the present invention with external heat sink means physically engaging an arc tube wall intermediate the discharge electrodes adjacent the hot spot region of the arc tube. Mercury condenses selectively on the inner arc tube wall adjacent the heat sink location during lamp cool down. Having the mercury condensate largely limited to the hot spot region of the arc tube by these means causes a more rapid rate of mercury discharge illumination when the lamp is subsequently restarted. Since less mercury has condensed on the discharge electrodes during lamp cool-down, there is less likelihood of causing the light hole with relatively instant mercury vaporization from the electrodes. Light loss caused by mercury recondensation on the present arc tube walls during restart should also be less. A slower heating of the arc tube wall at the heat sink location relative to adjoining arc tube walls will impede mercury recondensation on the hotter wall locations. Accordingly thermal management of mercury condensation in the arc tube proceeds in a distinctive manner during lamp cool-down and restart. The present heat sink means causes mercury to be condensed at a new location during lamp cool-down where it can be vaporized more readily during lamp restart while also causing the vaporized mercury to be less subject to recondensation elsewhere on the arc tube walls.

A suitable heat sink member for this purpose can be formed with a variety of heat-conductive solids to include metals such as copper and aluminum as well as ceramic compositions such as silicon carbide and aluminum nitride. Metal containing ceramic compositions such as alumina filled with heat-conductive metal particulates are also deemed useful construction materials for the present heat sink member. Correspondingly, a suitable heat sink member can have various physical configurations to include a heat-conductive metal element that is either maintained in physical contact with a wall of the arc tube member during lamp operation or bonded thereto with a refractory ceramic material. Alternately, a suitable heat sink construction for joinder to the arc tube wall can comprise a hollow fused quartz element containing a heat-conductive metal.

BRIEF DESCRIPTION OF THE DRAWINGS

FIG. 1 is a side view depicting an arc tube for a metal halide lamp which incorporates heat sink means according to the present invention.

FIG. 3 is a side view depicting a different physical configuration for a modified arc tube according to the present invention.

FIG. 4 is a perspective view depicting an automotive headlamp incorporating the quartz arc tube of FIG. 3 oriented horizontally.

DETAILED DESCRIPTION OF THE PREFERRED EMBODIMENTS

Figure 2:
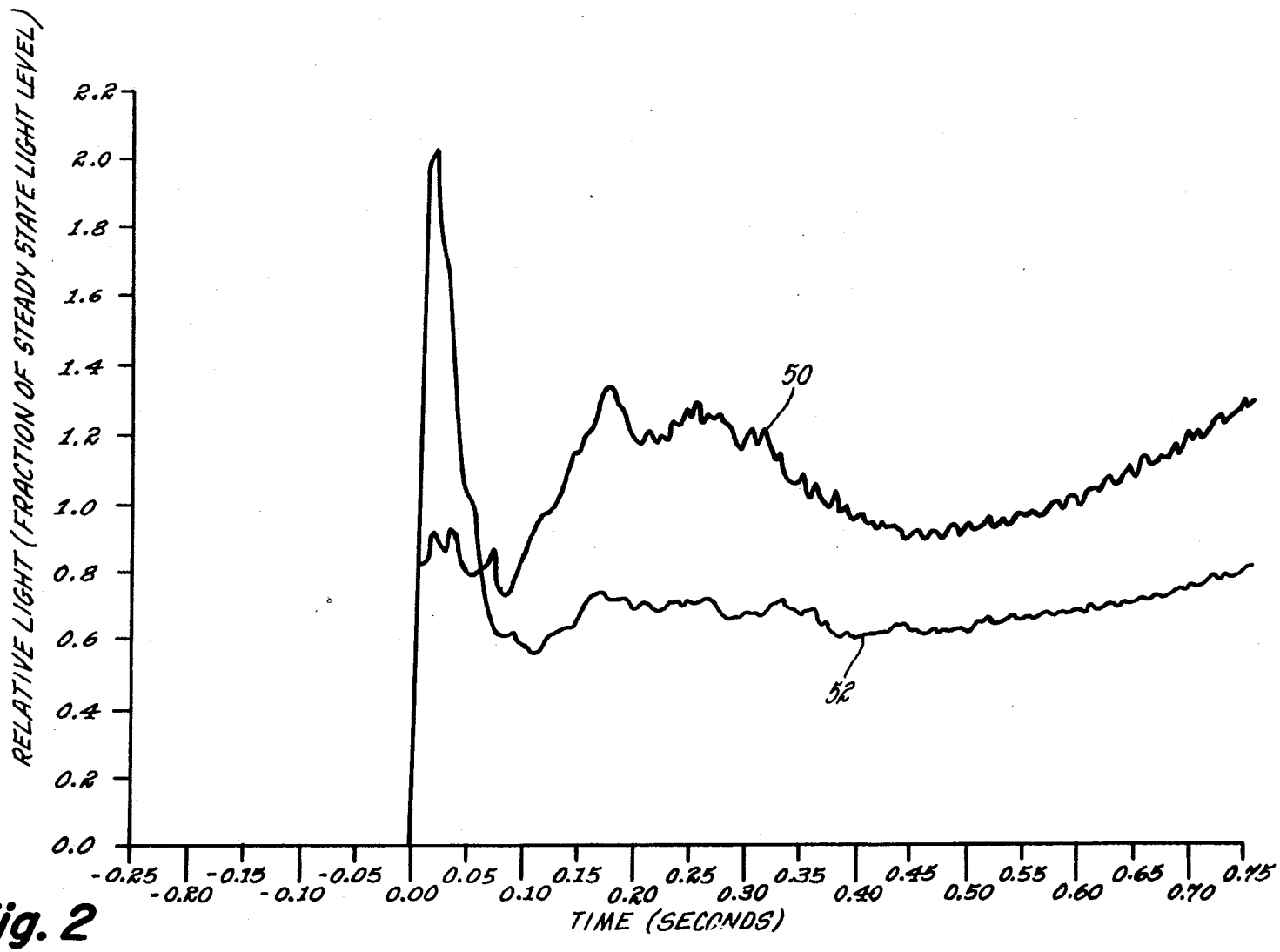
FIG. 2 is a graph illustrating the start-up mode of operation for the improved arc tube of FIG. 1 as compared with prior art arc tubes.

Referring to the drawings, FIG. 1 depicts a typical fused quartz arc tube construction 10 employing heat sink means according to the present invention. As shown in the drawing, the arc tube 10 has a double-ended configuration with an elongated hollow body 12 shaped to provide neck sections 14 and 16 at each end of a bulbous shaped central portion 18. Central portion 18 can have a typical overall length in the range from about five millimeters to about fifteen millimeters with a mid-point outer diameter from about three to about ten millimeters. Wall portions 20 and 22 of the hollow quartz body 12 hermetically seal a pair of electrodes 24 and 26 at opposite ends of the bulbous mid-portion 18 which can be separated from each other by a predetermined distance in the range of about two to about four millimeters. A single-ended arc tube configuration is also contemplated in accordance with the present invention wherein both electrodes are disposed at the same end of the arc tube and separated from each other by a predetermined spacing. Electrodes 24 and 26 both comprise rod-like members formed with a refractory metal such as tungsten or tungsten alloys and are configured to be of the same physical size when operated with an alternating current power source while generally being of dissimilar size when operated with a direct current power source. The electrode members are also of the already known spot-mode type so as to develop a thermionic arc condition within the arc tube 10 in a substantially instantaneous manner. Both electrodes 24 and 26 are hermetically sealed within the quartz envelope 12 with thin refractory metal foil elements 28 and 30 that are further connected to outer lead wire conductor 32 and 34, respectively. A fill (not shown) of xenon, mercury and a metal halide is further contained within the sealed cavity 18 of the quartz envelope. Refractory metal coils 36 and 38 serve only to centrally position the electrode members at the ends of the sealed arc tube envelope.

Arc tube 10 still further includes a heat sink member 40 secured to the outer surface of the arc tube top wall 20. As can be seen in the drawing, heat sink member 40 is positioned approximately midway between the spaced-apart electrodes 24 and 26 so as to coincide with the hot spot region of the arc tube during lamp operation. The heat sink member may comprise a short length of quartz tubing 42 either heat sealed or adhesively bonded with a refractory ceramic material (not shown) directly to the arc tube wall and contains a fill of heat-conductive metal 44, such as aluminum, in the hollow cavity 46. The heat being conductively removed through the walls of arc tube 10 by such heat sink means causes mercury to be selectively condensed within the arc tube when lamp operation is suspended. More particularly, the mercury condensation will now be primarily limited within the arc tube cavity 18 to only that region adjacent to heat sink member 40 rather than occurring throughout the inner walls of the arc tube cavity.

The graph in FIG. 2 illustrates performance characteristics for a 30 watt size instant light xenon-metal halide lamp and shows the effectiveness of the present improvement. Curve 50 represents light output measurements for such a lamp employing the heat sink means of the present invention. The lamp contained a xenon fill pressure of approximately four atmospheres. Curve 52 represents comparable measurements for such a lamp without the present heat sink means. As can be noted from a comparison of curves 50 and 52, both lamps achieved an almost immediate xenon light peak at the instant of lamp start-up. Light output for the lamp without the present heat sink means (curve 52) displayed the light loss previously described. The lamp does supply the fifty percent of the steady state illumination required by such a lamp within 0.75 second from lamp start-up at a starting current value of approximately 5.5 amperes during the test measurement period. However, the light loss experienced during start-up with a lamp construction according to the present invention (curve 50) is reduced, such that the lamp meets the desired performance standard by a greater margin. These results clearly show that use of the heat sink reduces the light hole effect and would obviously help lamps that did not meet the start-up specification to meet it. After start-up, a constant steady state light output is achieved under lamp operating conditions wherein the lamp current is exponentially reduced to a predetermined steady state value with the lamp electrodes being maintained in a temperature range from about 2200° C. up to about the melting point of the refractory metal selected for electrode construction in order to sustain the arc discharge.

As previously indicated, it is not essential for the heat sink member to be actually fastened to the arc tube for effective heat removal therefrom during lamp operation. It is only necessary that physical contact be maintained therebetween for the desired heat removal to occur. An alternative arrangement is particularly suitable in lamp units wherein the quartz arc tube is physically suspended within outer housing means, such as within a reflector member. The reflector enables the heat sink member to be supported therein so as to provide the required heat transfer cooperation between the heat sink and arc tube members. An automotive headlamp unit employing such alternative construction is further described with reference to FIGS. 3 and 4.

FIG. 3 depicts an arc tube assembly 60 wherein the arc tube member 62 physically engages a metal foil heat sink member 64 so as to enable the desired heat transfer cooperation therebetween. As can be seen in the drawing, heat sink member 64 is constructed of a spring-like heat-conductive metal bent in a U shape with extending arms 66 and 68. Arm 66 enables the heat sink member to be physically attached to support means of a lamp unit (not shown) whereas arm 68 exerts a mechanical spring force downward when physically engaged with the upper wall exterior surface of arc tube member 62. A further curved section 70 in arm 68 conforms to the curved exterior wall of the arc tube 62 to help increase the effective heat transfer area between the heat sink and arc tube. As can be further seen in FIG. 3, fused quartz arc tube 62 employs the same double-ended configuration hereinbefore described. Accordingly, said arc tube includes a pair of spot-mode type discharge electrodes 72 and 74 hermetically sealed within respective neck portions 76 and 78 of the hollow quartz envelope at opposite ends of a bulbous central cavity 80. The discharge electrodes are connected at the outer ends to refractory metal foil elements 82 and 84 with the seal elements being then connected to respective outer lead conductors 86 and 88. A fill (not shown) of xenon, mercury and a metal halide is contained within the bulbous central cavity 80. Placement of heat sink member 64 between the spaced-apart discharge electrodes 72 and 74 of the arc tube 62 at the top wall surface where the hot spot occurs enables maximum heat removal to be achieved. Desirably, the mass of the heat sink member substantially exceeds the quartz mass in the arc tube member.

An additional evaluation was conducted with arc tube 62 wherein the heat sink member 64 was formed with a copper metal block. The arc tube was operated with a direct current power source enabling spot mode ignition of the discharge electrodes at a starting current level of approximately 5.5 amperes. Light output of the tested arc tube substantially increased from the moment of lamp start-up and thereafter was maintained at a relatively steady state value. In conducting the test measurements, the arc tube was started with the heat sink member in place and run for approximately one minute after which the power was turned off and the arc tube allowed to cool for approximately fifteen minutes. The heat sink member was then removed from physical contact with the top wall surface of the arc tube in order to visually observe where mercury had condensed within the arc tube cavity. Mercury was found to have condensed on the top wall inner surface of the arc tube in a region primarily limited to the former location of the heat sink. It follows from these results that light loss is significantly reduced during lamp start-up when mercury condensation can be effectively directed to a limited region of the arc tube walls with the present heat sink means.

A similar evaluation was conducted for a ceramic heat sink member formed with a silicon carbide block. Such evaluation consisted of visually observing the location of mercury condensation within the same arc tube member evaluated in the immediately preceding embodiment when operated with the silicon carbide block in place. Under the same lamp operating conditions, it was observed that mercury condensation was again effectively directed to a top wall region in the arc tube where the heat sink member had been located.

FIG. 4 is a perspective view depicting an automotive headlamp incorporating the quartz arc tube assembly 60 of FIG. 3 wherein the arc tube 62 is oriented in a horizontal axial manner. The automotive headlamp 90 includes a reflector 92, a lens 94 secured to the front section of the reflector, connection means 96 secured at the rear section of the reflector for connection to a power source, and the metal halide light source 62. Reflector member 92 has a truncated parabolic contour with flat top and bottom wall portions 98 and 100, respectively, intersecting the parabolic curved portion 102. Connection means 96 of the reflector includes prongs 104 and 106 which are capable of being connected to a ballast (not shown) which drives the lamp and which in turn is driven by the power source of the automotive vehicle. The reflector 92 has a predetermined focal point 108 as measured along the axis 110 of the automotive headlamp 90 which is located at about mid-point of the arc tube 62. Arc tube 62 is predeterminently positioned within the reflector 92 so as to be approximately disposed near the focal point 108 of the reflector. For the presently illustrated embodiment, the arc tube 62 is oriented along axis 110 of the reflector. The reflector cooperates with its light source 62 by reason of its parabolic shape and with lens 94 affixed thereto being of a transparent material which can include prism elements (not shown) also cooperating to provide a predetermined forward projecting light beam from the light source. Arc tube 62 is connected to the rear of reflector 92 by a pair of relatively stiff self-supporting lead conductors 112 and 114 which are further connected at the opposite ends to the respective prong elements 104 and 106. Reflector 92 also includes a conventional heat shield 116 which is affixed to top wall portion 98 of the reflector. A heat sink member 64 is physically supported from heat shield 116 so as to exert a downward spring force action upon also suspended arc tube 62. Since it will be apparent to those skilled in the art, however, that other structural arrangements may be utilized to provide heat sink means within a reflector member, it is not intended that the structural means shown limit the scope of the invention.

It will be apparent from the foregoing description that novel means have been provided to more effectively exercise thermal management of mercury condensation in metal halide lamps. It will be apparent that further modification can be made in physical features of a suitable heat sink member and arc tube to achieve the same purpose without departing from the spirit and scope of the present invention. Configurations for a fused quartz arc tube, electrode members and reflector lamp designs other than illustrated herein are also contemplated. For example, an automotive headlamp having the arc tube aligned transverse to the lamp axis and which includes the present heat sink means is contemplated. Consequently, it is intended to limit the present invention only by the scope of the appended claims.

What we claim as new and desire to secure by Letters Patent of the United States is:

1. A metal halide lamp experiencing low light loss during lamp start-up comprising in combination:

(a) a fused quartz arc tube having a hollow cavity formed with walls hermetically sealing spaced-apart discharge electrodes therein and further containing a fill of mercury, a metal halide and an inert gas, (b) external heat sink means physically engaging the exterior surface of one arc tube wall, (c) the heat sink means being disposed intermediate the discharge electrodes adjacent the hot spot region of the arc tube for selective condensation of mercury vapor on the inner surface of the arc tube wall at such location; and, (d) said heat sink means being of a reduced size relative to the surface area of said arc tube and being disposed on a portion of the equatorial surface of said arc tube so as to reduce light blockage by said heat sink means and further being effective during a restarting operation following a recent extinguishment of the arc discharge within said arc tube for preventing condensation of said mercury near said discharge electrodes which would otherwise block light generated immediately upon occurrence of such restarting operation.

2. The lamp of claim 1 wherein the heat sink means are formed with a heat-conductive metal.

3. The lamp of claim 1 wherein the heat sink means are formed with a heat-conductive ceramic composition.

4. The lamp of claim 1 wherein the heat sink means comprise a hollow fused quartz element containing a heat-conductive metal.

5. The lamp of claim 4 wherein the heat-conductive metal is aluminum.

6. The lamp of claim 1 wherein the heat sink means are secured to the arc tube wall.

7. The lamp of claim 1 wherein the discharge electrodes are disposed at opposite ends of the arc tube.

8. The lamp of claim 1 wherein the arc tube includes a bulbous shaped central portion and the heat sink means are located approximately at the mid-point of said bulbous shaped central portion.

9. The lamp of claim 1 wherein the inert gas contained within the arc tube is xenon.

10. A xenon-metal halide lamp experiencing low light loss during lamp start-up comprising in combination:

(a) a fused quartz arc tube having a hollow cavity formed with walls hermetically sealing a pair of spaced-apart discharge electrodes therein and further containing a fill of mercury, a metal halide and xenon gas at a relatively high pressure, (b) an external heat sink member physically engaging the top wall surface of the arc tube, (c) the heat sink member being disposed intermediate the discharge electrodes adjacent the hot spot region of the arc tube for selective condensation of mercury vapor on the inner surface of the arc tube wall at such location; and, (d) said heat sink means being of a reduced size relative to the surface area of said arc tube and being disposed on a portion of the equatorial surface of said arc tube so as to reduce light blockage by said heat sink means and further being effective during a restarting operation following a recent extinguishment of the arc discharge within said arc tube for preventing condensation of said mercury near said discharge electrodes which would otherwise block light generated immediately upon occurrence of such restarting operation.

11. The lamp of claim 10 wherein the discharge electrodes are disposed at opposite ends of the arc tube.

12. The lamp of claim 10 wherein the heat sink member is formed with a heat-conductive metal.

13. The lamp of claim 10 wherein the heat sink member is formed with a heat-conductive ceramic composition.

14. The lamp of claim 10 wherein both discharge electrodes comprise rod-like members formed with a refractory metal.

15. An automotive headlamp which comprises:

(a) a reflector member for connection to a power source, the reflector member having a predetermined focal length and focal point, (b) a lens member joined to the front section of the reflector, (c) a fused quartz arc tube predeterminently positioned within the reflector so as to be approximately disposed adjacent the focal point of the reflector and experiencing low light loss during lamp start-up, the fused quartz arc tube having a hollow cavity formed with walls hermetically sealing a pair of discharge electrodes therein and containing a fill of mercury, a metal halide and an inert gas, the arc tube further having an external heat sink means physically engaging the exterior surface of one arc tube wall, the heat sink means being disposed intermediate the discharge electrodes adjacent the hot spot region of the arc tube for selective condensation of mercury vapor on the inner surface of the arc tube at such location; and, (d) said heat sink means being of a reduced size relative to the surface area of said arc tube and being disposed on a portion of the equatorial surface of said arc tube so as to reduce light blockage by said heat sink means and further being effective during a restarting operation following a recent extinguishment of the arc discharge within said arc tube for preventing condensation of said mercury near said discharge electrodes which would otherwise block light generated immediately upon occurrence of such restarting operation.

16. The automotive headlamp of claim 15 wherein the reflector has a parabolic configuration.

17. The automotive headlamp of claim 15 wherein the lens includes prism elements.

18. The automotive headlamp of claim 15 wherein the arc tube is positioned horizontally within the reflector and the heat sink member is affixed to the top wall of said arc tube.

* * * * *